US009030361B2

(12) United States Patent
Desclos et al.

(10) Patent No.: US 9,030,361 B2
(45) Date of Patent: May 12, 2015

(54) AUTOMATIC SIGNAL, SAR, AND HAC ADJUSTMENT WITH MODAL ANTENNA USING PROXIMITY SENSORS OR PRE-DEFINED CONDITIONS

(71) Applicant: Ethertronics, Inc., San Diego, CA (US)

(72) Inventors: Laurent Desclos, San Diego, CA (US); Barry Matsumori, La Jolla, CA (US); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 267 days.

(21) Appl. No.: 13/674,117

(22) Filed: Nov. 12, 2012

(65) Prior Publication Data

US 2013/0127670 A1 May 23, 2013

Related U.S. Application Data

(63) Continuation-in-part of application No. 13/029,564, filed on Feb. 17, 2011, now Pat. No. 8,362,962, which is a continuation of application No. 12/043,090, filed on Mar. 5, 2008, now Pat. No. 7,911,402.

(51) Int. Cl.

| | |
|---|---|
| ***H01Q 1/38*** | (2006.01) |
| ***H01Q 25/04*** | (2006.01) |
| ***H01Q 1/24*** | (2006.01) |
| ***H01Q 3/00*** | (2006.01) |
| ***H01Q 9/04*** | (2006.01) |

(52) U.S. Cl.
CPC ..... *H01Q 25/04* (2013.01); *H01Q 1/243* (2013.01); *H01Q 3/00* (2013.01); *H01Q 9/0421* (2013.01)

(58) Field of Classification Search
CPC ..... H01Q 1/243; H01Q 25/04; H01Q 3/00; H01Q 9/0421
USPC ..... 343/700 MS, 745, 815, 818, 834
See application file for complete search history.

(56) References Cited

U.S. PATENT DOCUMENTS

| | | | | |
|---|---|---|---|---|
| 6,166,694 | A * | 12/2000 | Ying | 343/702 |
| 6,326,921 | B1 * | 12/2001 | Egorov et al. | 343/700 MS |
| 7,319,432 | B2 * | 1/2008 | Andersson | 343/702 |
| 7,834,813 | B2 * | 11/2010 | Caimi et al. | 343/745 |
| 2007/0241977 | A1 * | 10/2007 | Vance | 343/745 |

* cited by examiner

*Primary Examiner* — Tho G Phan
(74) *Attorney, Agent, or Firm* — Coastal Patent Law Group, P.C.

(57) ABSTRACT

A modal adaptive antenna system that dynamically samples proximity sensors or other sensors to determine the use case for the wireless device and then adjust the antenna radiating mode to optimize communication link performance. The modal adaptive antenna system is capable of modifying the antenna radiation pattern to improve communication link quality along with near-field parameters such as SAR and HAC. An algorithm and look-up table containing pre-measured electrical parameters to include TRP, TIS, and SAR are developed and integrated with hardware which includes an antenna and active components to dynamically modify the radiation pattern of the antenna as well as proximity sensors and or other sensing devices.

6 Claims, 10 Drawing Sheets

| Mode 1 | Mode 2 | | Mode N |
|---|---|---|---|
| TRP1 | TRP2 | | TRPN |
| TIS1 | TIS2 | | TISN |
| SAR1 | SAR2 | | SARN |
| HAC | HAC2 | | HACN |

Average numbers for TIS and TRP

| Ant. Mode | Mode 1 | Mode 2 | Mode 3 | | | | Mode N |
|---|---|---|---|---|---|---|---|
| sensor | conf1 | conf1 | conf1 | conf1 | conf1 | conf1 | conf1 |
| TRP | | | | | | | |
| TIS | | | | | | | |
| SAR | | | | | | | |
| HAC | | | | | | | |

Figure 6

Mode 1 of the antenna gives a link with base station A which is marginal

AUTOMATIC SIGNAL, SAR, AND HAC ADJUSTMENT WITH MODAL ANTENNA USING PROXIMITY SENSORS OR PRE-DEFINED CONDITIONS

CROSS-REFERENCE TO RELATED APPLICATIONS

This application is a continuation-in-part (CIP) of commonly owned U.S. Ser. No. 13/029,564, filed Feb. 17, 2011, titled "ANTENNA AND METHOD FOR STEERING ANTENNA BEAM DIRECTION"; which in turn claims priority to:

U.S. Ser. No. 12/043,090, filed Mar. 5, 2008, titled "ANTENNA AND METHOD FOR STEERING ANTENNA BEAM DIRECTION", issued as U.S. Pat. No. 7,911,402 on Mar. 22, 2011;

the contents of each of which are hereby incorporated by reference.

BACKGROUND OF THE INVENTION

1. Field of the Invention

This invention relates generally to the field of wireless communication. In particular, this invention relates to antenna systems and methods for optimizing communication link quality with intended transceivers.

2. Description of the Related Art

As new generations of handsets, gateways, and other wireless communication devices become embedded with more applications and the need for bandwidth becomes greater, new antenna systems will be required to optimize link quality. Specifically, better control of the radiated field will be required to provide better communication link quality with intended transceivers while suppressing signals from undesired transceivers.

Today's mobile wireless devices must meet a stringent set of requirements that relate to the radiated performance of the antenna system on the mobile side. These requirements cover parameters such as total radiated power (TRP), total isotropic sensitivity (TIS), specific absorption rate (SAR) and hearing aid compatibility (HAC). SAR tends to increase with increasing TRP, as well as interference which will cause HAC to fail to meet requirements. One method to reduce SAR and/or HAC in a wireless mobile device is to reduce the transmit power. This technique, unfortunately, results in reduced communication link quality caused by decreased transmit power.

Proximity sensors and other sensors are being integrated into current cell phones and other wireless devices for a variety of applications. These proximity sensors are typically used to power down the display when the cell phone is placed against the user's head. This results in power savings which translates into increased battery life, an important parameter in mobile wireless devices.

Certain improvements in the art can be realized by using the existing proximity sensors and other sensors within a cell phone, tablet, laptop, or other wireless device, to determine various use cases of a particular device for managing device requirements such as total radiated power (TRP), total isotropic sensitivity (TIS), specific absorption rate (SAR) and hearing aid compatibility (HAC).

SUMMARY OF THE INVENTION

A method has been derived to dynamically sample near-field properties derived from proximity sensors or other sensors integrated into a mobile device and modify the antenna radiation pattern to improve communication link quality along with near-field parameters such as SAR. An algorithm and look-up table containing pre-measured electrical parameters to include TRP, TIS, and SAR are developed and integrated with hardware which includes an antenna and active components to dynamically modify the radiation pattern of the antenna as well as proximity sensors and or other sensing devices.

In one aspect of the present invention, an antenna with dynamic beam steering capability is integrated with proximity or other sensor types to provide a method of improving or maintaining radiated performance while minimizing SAR. An algorithm and look-up table containing pre-measured electrical parameters to include TRP, TIS, and SAR is provided to provide the necessary information required to select the optimal antenna beam state for a specific use case.

BRIEF DESCRIPTION OF THE DRAWINGS

FIG. 6 illustrates a look-up table that relates the multiple modes that can be generated by the dynamically adjusted antenna to sensor inputs and electrical parameters.

DETAILED DESCRIPTION OF THE PREFERRED EMBODIMENTS

The antenna systems and methods described herein utilize a beam steering technique to reduce interference from one or multiple sources. A platform has been derived to increase the link budget based on the modification of the antenna radiation pattern and is, in part, based upon U.S. Ser. No. 12/043,090, filed Mar. 5, 2008, titled "ANTENNA AND METHOD FOR STEERING ANTENNA BEAM DIRECTION", which issued as U.S. Pat. No. 7,911,402 on Mar. 22, 2011, hereinafter "the '402 patent"; the contents of which are hereby incorporated by reference. The '402 patent describes a modal adaptive antenna system, which uses an antenna radiation pattern beam steering technique to improve communication link quality between the mobile wireless device and the base terminal. This technique provides an antenna with multiple radiation pattern states along with an algorithm to dynamically sample link performance and adjust the radiation pattern of the mobile antenna to improve communication link quality. This technique is designed to improve the communication link quality, which is a far-field parameter.

The '402 patent referenced above will now be discussed in more detail with reference to certain figures. In sum, a beam steering technique is effectuated with the use of a driven antenna element and one or more offset parasitic elements that alter the current distribution on the driven antenna as the reactive load on the parasitic is varied. More specifically, one or more of the parasitic elements can be positioned for band-switching, i.e. within the antenna volume created by the driven element and the circuit board, and one or more additional parasitic elements may be positioned outside the antenna volume and adjacent to the driven element to effectuate a phase-shift in the antenna radiation pattern. Multiple modes are generated, each mode characterized by the reactance or switching of parasitic elements, and thus this technique can be referred to as a "modal antenna technique", and an antenna configured to alter radiating modes in this fashion can be referred to as an "active multimode antenna" or "active modal antenna". The frequency of operation of the driven antenna varies as a function of reactive loading of the parasitic. This technique allows for the frequency of operation to remain constant as the radiation pattern is altered.

Figure 1:
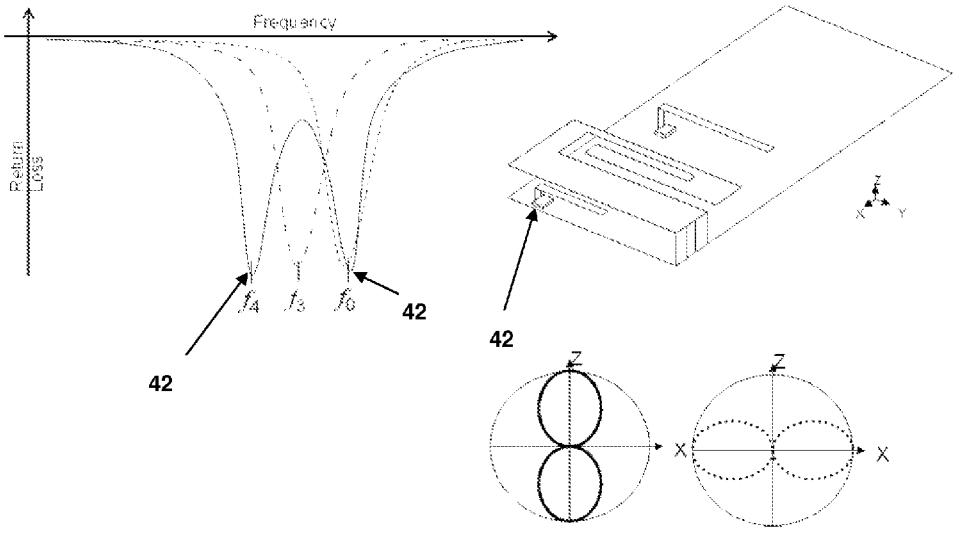
FIG. 1 illustrates a modal antenna in accordance with various embodiments.

Now turning to the drawings, FIGS. 1(*a-c*) illustrate an example of an active modal antenna in accordance with the '402 patent, wherein FIG. 1*a* depicts a circuit board 11 and a driven antenna element 10 disposed thereon, a volume between the circuit board and the driven antenna element forms an antenna volume. A first parasitic element 12 is positioned at least partially within the antenna volume, and further comprises a first active tuning element 14 coupled therewith. The first active tuning element 14 can be a passive or active component or series of components, and is adapted to alter a reactance on the first parasitic element either by way of a variable reactance, or shorting to ground, resulting in a frequency shift of the antenna. A second parasitic element 13 is disposed about the circuit board and positioned outside of the antenna volume. The second parasitic element 13 further comprises a second active tuning element 15 which individually comprises one or more active and passive components. The second parasitic element is positioned adjacent to the driven element and yet outside of the antenna volume, resulting in an ability to steer the radiation pattern of the driven antenna element by varying a current flow thereon. This shifting of the antenna radiation pattern is a type of "antenna beam steering". In instances where the antenna radiation pattern comprises a null, a similar operation can be referred to as "null steering" since the null can be steered to an alternative position about the antenna. In the illustrated example, the second active tuning element comprises a switch for shorting the second parasitic to ground when "On" and for terminating the short when "Off". It should however be noted that a variable reactance on either of the first or second parasitic elements, for example by using a variable capacitor or other tunable component, may further provide a variable shifting of the antenna pattern or the frequency response. FIG. 1*c* illustrates the frequency ($f_0$) of the antenna when the first and second parasitic are switched "Off"; the split frequency response ($f_L$;$f_H$) of the antenna when the second parasitic is shorted to ground; and the frequencies ($f_4$; $f_0$) when the first and second parasitic elements are each shorted to ground. FIG. 1*b* depicts the antenna radiation pattern in a first mode 16 when both the first and second parasitic elements are "Off"; in a second mode 17 when only the second parasitic is shorted to ground; and a third mode 18 when both the first and second parasitic elements are shorted "On". Further details of this active modal antenna can be understood upon a review of the '402 patent; however generally one or more parasitic elements can be positioned about the driven element to provide band switching (frequency shifting) and/or beam steering of the antenna radiation pattern which is actively controlled using active tuning elements.

Figure 2:
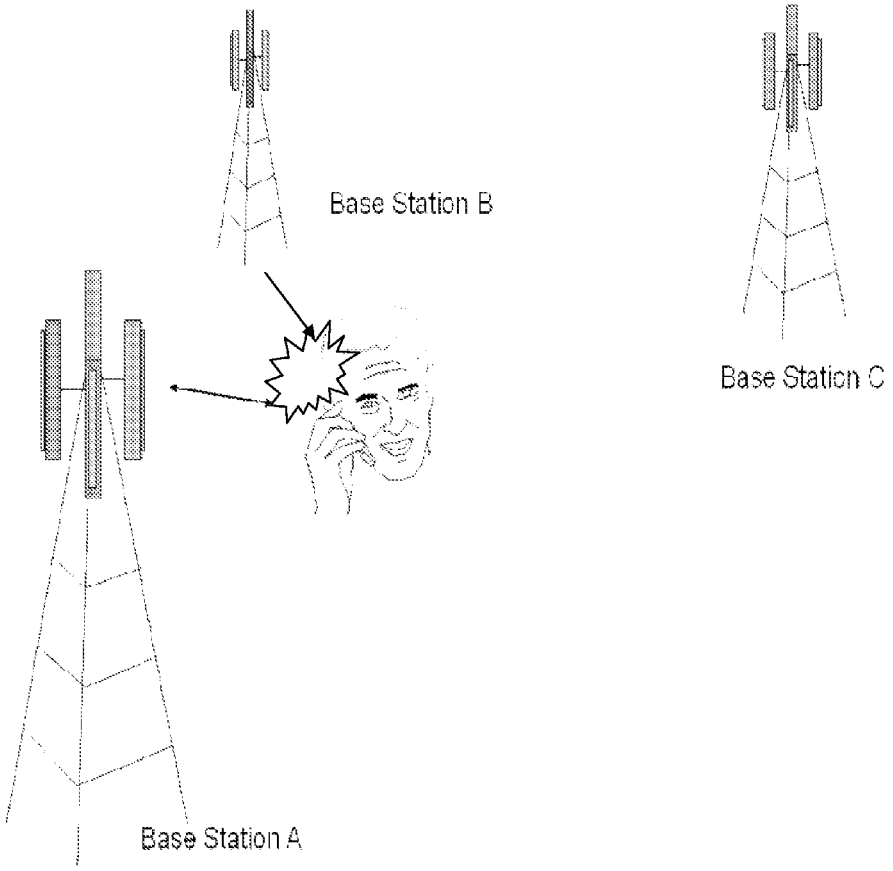
FIG. 2 illustrates a schematic of a wireless device with a modal antenna coupled to a wireless network having multiple base stations.

FIG. 2 illustrates an example of a modal adaptive antenna described in the '402 patent. The antenna radiation pattern can be dynamically adjusted to optimize communication link performance between the mobile wireless device and one or multiple base stations. Three base stations, each designated A, B and C, respectively, are shown along with a mobile wireless device, in this case a cell phone, which contains a modal adaptive antenna system.

The antenna system generally comprises a modal adaptive antenna, one or more sensors such as proximity sensors, capacitive sensors, ultra-sonic sensors, infra-red sensors, or other sensors for determining the device use case, a processor which can be the baseband processor of the mobile device or a separate applications processor, and memory containing a lookup table or data set relating information for each antenna mode of the modal adaptive antenna, each device use case such as held in hand against head, etc., and various measurements of TRP, TIS, SAR, HAC. In this regard, the antenna system is adapted to determine a current device use case using information from the proximity or other sensors, determine an optimal mode for balancing antenna efficiency and signal quality with one or more of TRP, TIS, SAR, and HAC.

Although TRP, TIS, SAR, and HAC are illustrated examples of requirements for consideration of antenna engineers, other metrics may become of interest in the industry and may therefore become implemented in a similar fashion.

Figure 3:
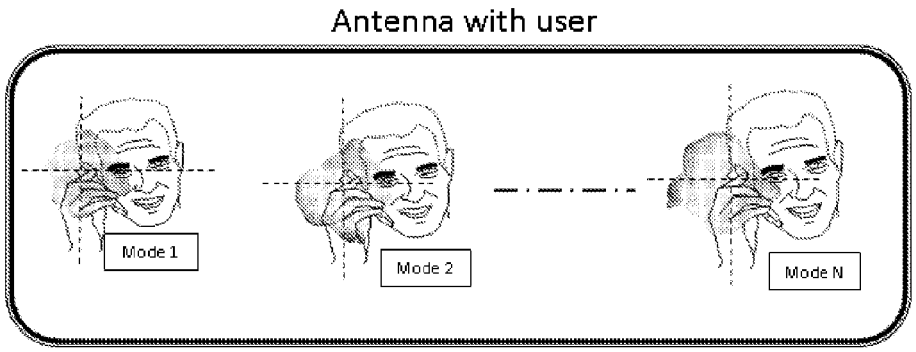
FIG. 3 illustrates a modal adaptive antenna with N modes or radiation pattern states integrated into a cell phone along with a look-up table of pre-measured electrical parameters.

FIG. 3 illustrates a modal adaptive antenna with N modes or radiation pattern states integrated into a cell phone along with a look-up table of pre-measured electrical parameters, in this case total radiated power (TRP), total isotropic sensitivity (TIS), specific absorption rate (SAR) and hearing aid compatibility (HAC). The look-up table is shown with these parameters for the N states. It should however be noted that those having skill in the art would be readily able to customize the lookup table as necessary to manage one or more of these requirements within a particular application.

Figure 4:
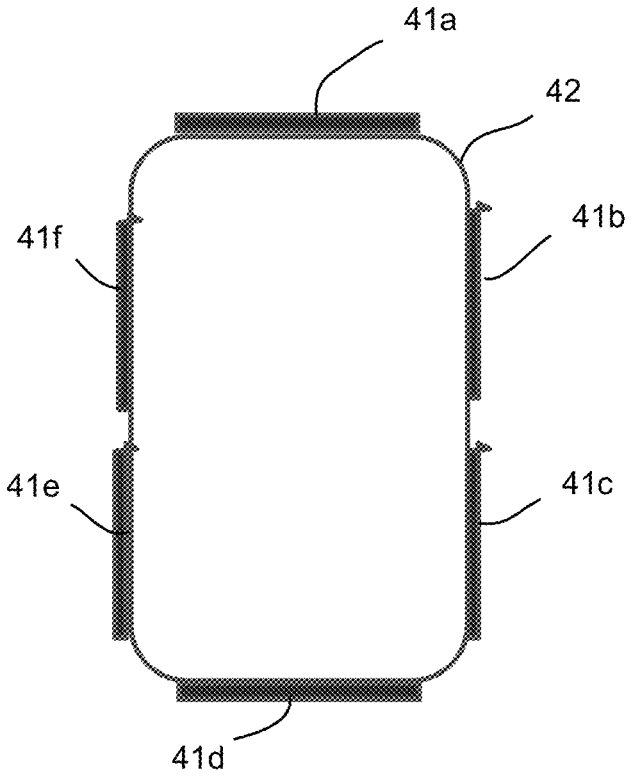
FIG. 4 illustrates a mobile wireless device with proximity sensors integrated at multiple locations.

FIG. 4 illustrates a mobile wireless device 42 with proximity sensors 41(*a-f*), respectively, integrated at multiple locations. The proximity sensors are placed about the device in a manner sufficient to sense and determine which use case the device is currently in at any given time: in the user's hand, against the user's head, resting on a surface such as a table, placed on a metal surface, etc. Based on the use case of the device as detected by the proximity sensors, the modal adaptive antenna is adapted to select a mode from a plurality of possible modes of the modal adaptive antenna that provides improved signal quality or one of the metrics described above, specifically, TRP, TIS, SAR, and HAC.

Figure 5:
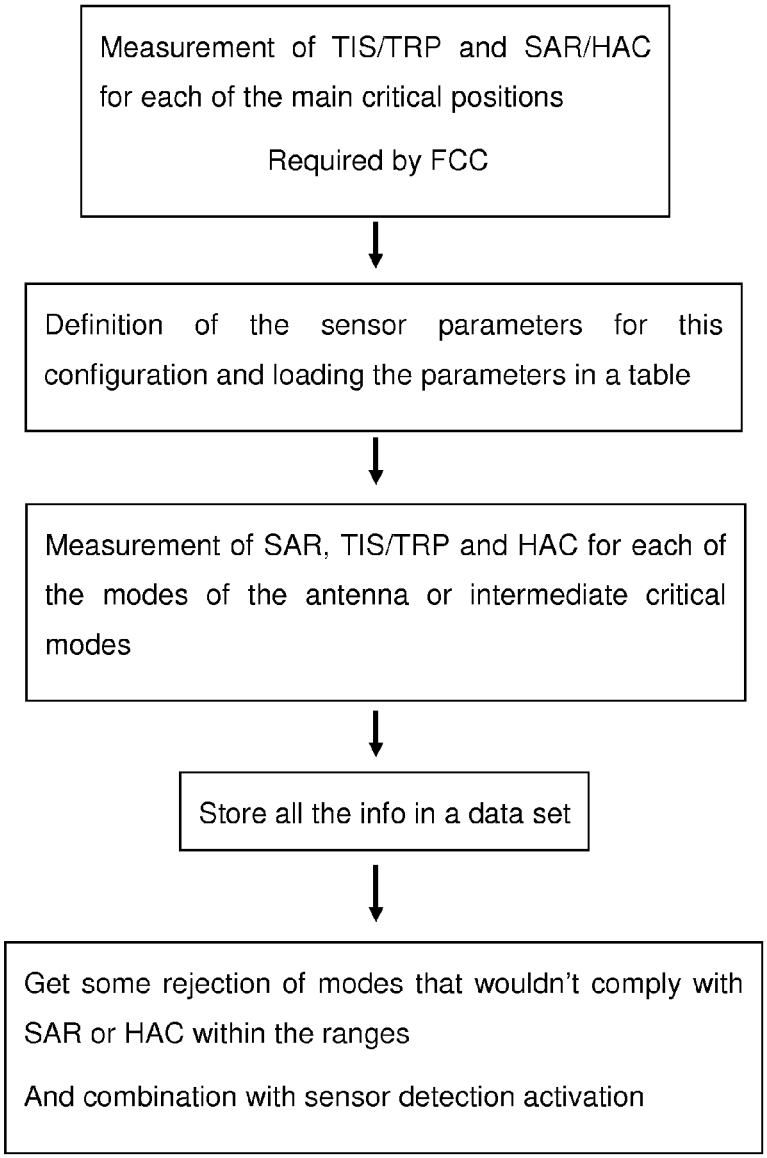
FIG. 5 illustrates a process for measuring electrical parameters for multiple use cases and correlating the parameters to proximity sensor states.

FIG. 5 describes a process for measuring electrical parameters for multiple use cases and correlating the parameters to proximity sensor states. The process comprises: (i) measuring TIS/TRP and SAR/HAC for each of the main critical positions or use cases; (ii) for each use case, defining the sensor parameters for configuration and loading the parameters in a table; (iii) measuring SAR, TIS, TRP and HAC for each of the modes of the antenna or intermediate critical modes; (iv) storing all information from these measurements in a data set; and (v) obtain some rejections of modes that wouldn't comply with SAR or HAC within the ranges and combination with sensor detection activation.

FIG. 6 illustrates a look-up table that relates the multiple modes that can be generated by the dynamically adjusted antenna to sensor inputs and electrical parameters, i.e. TRP, TIS, SAR, and HAC.

Figure 7:
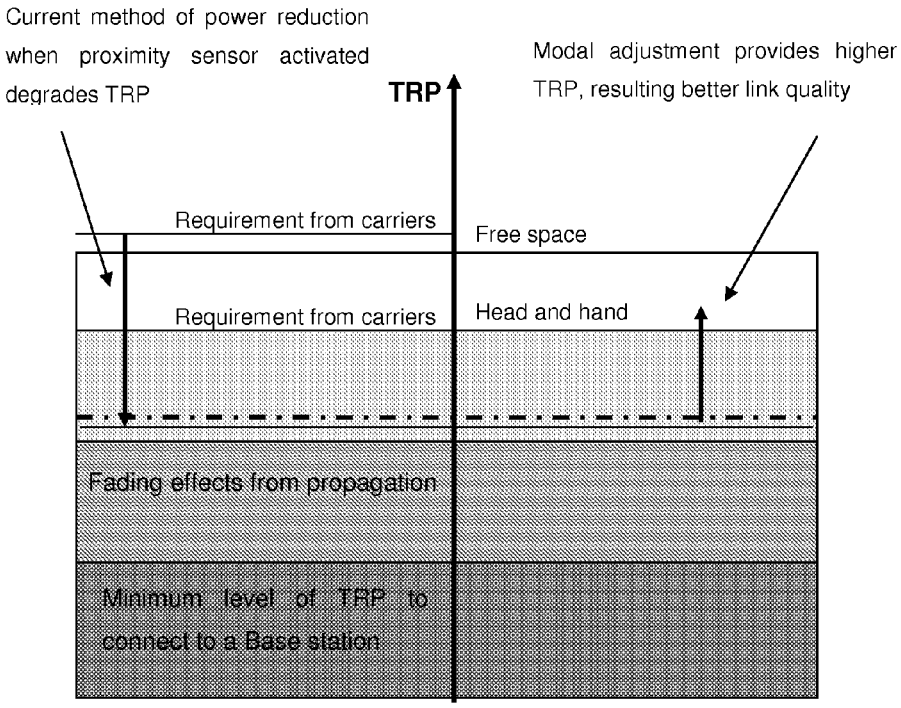
FIG. 7 illustrates a schematic that compares the two methods for reducing SAR and or HAC: a simple "power down" method where transmit power is reduced to reduce SAR and HAC, and the adaptive modal antenna method where proximity sensors are surveyed and used to determine optimal adjustment of the antenna radiation characteristics.

FIG. 7 is a graphic that compares the two methods for reducing SAR and or HAC: a simple "power down" method where transmit power is reduced to reduce SAR and HAC, and the adaptive modal antenna method where proximity sensors are surveyed and used to determine optimal adjustment of the antenna radiation characteristics.

Figure 8:
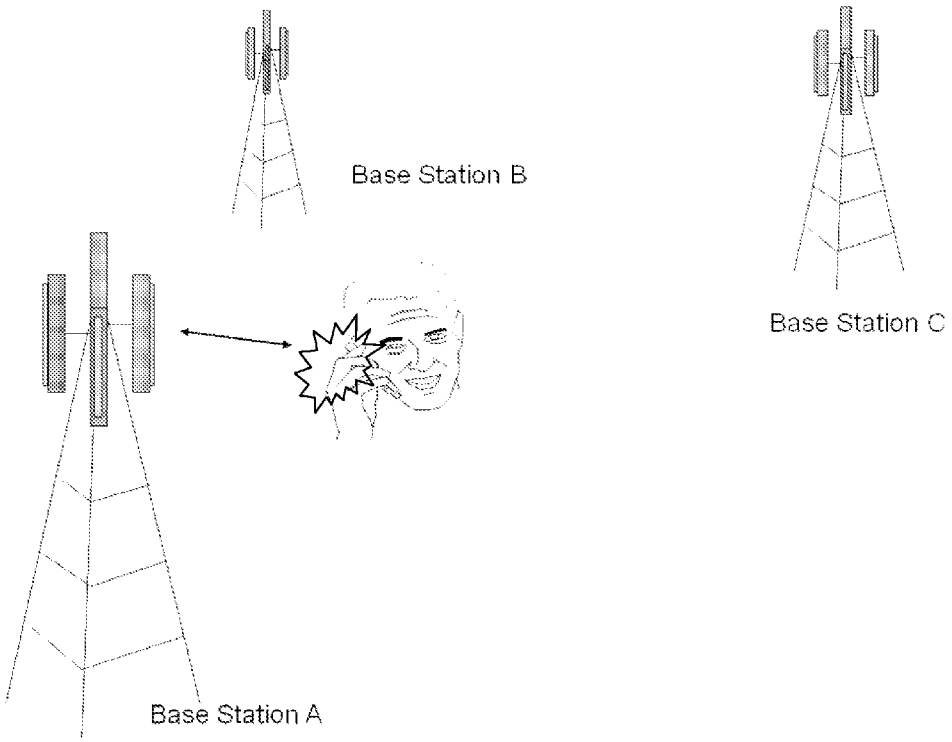
FIG. 8 illustrates an example where several base stations in a network, designated A, B and C, respectively, are potentially within range of a mobile device wherein the device makes a marginal signal link with the base station network.

FIG. 8 illustrates an example where several base stations, designated A, B and C, respectively, are potentially within range of a mobile device. The mode selected initially provides only a marginal link with Base Station A.

Figure 9:
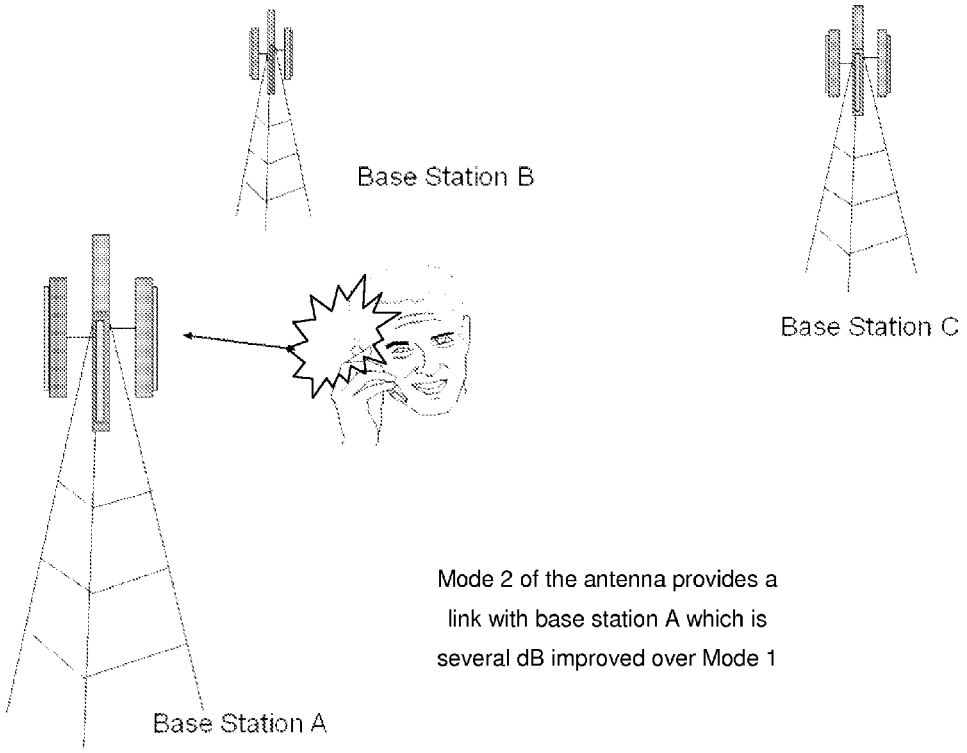
FIG. 9 illustrates an example where several base stations in a network, designated A, B and C, respectively, are potentially within range of the mobile device, the selection of a different mode allows an improved signal with the base station network.

FIG. 9 illustrates an example where several base stations, designated A, B and C, respectively, are potentially within range of the mobile device. The selection of a different mode now provides multiple dBs of improved link with Base Station A.

Figure 10:
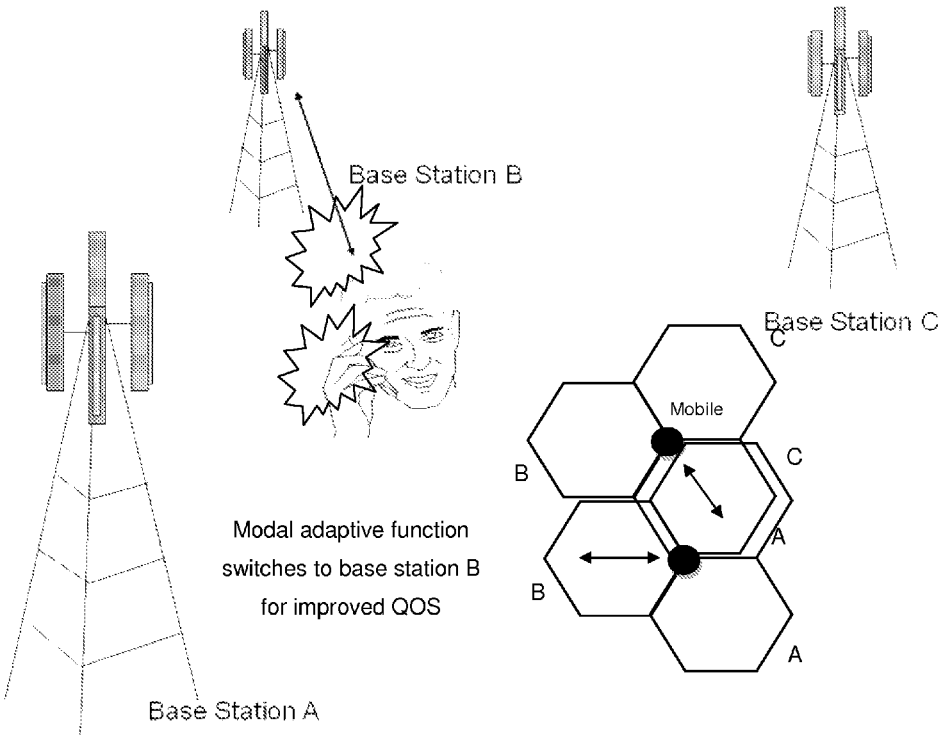
FIG. 10 illustrates a diagram that shows the modal adaptive antenna can switch to a mode that is optimal for communication with base station B when this base station is the preferred base station for communication

FIG. 10 illustrates an example where several base stations, designated A, B and C, respectively, are potentially within range of the mobile device. The diagram shows that the modal adaptive antenna will switch to a mode that is optimal for communication with base station B when this base station is the preferred base station for communication.

Thus, in certain embodiments, an antenna system for use with a wireless device comprises: an antenna element positioned above a circuit board forming an antenna volume therebetween, a first parasitic element positioned adjacent to the antenna element and outside of the antenna volume, and a second parasitic element positioned within the antenna volume; one or more sensors positioned about the device; and a processor configured to: utilize information from the one or more sensors to determine a current use case of the device from a plurality of potential use cases, access data stored in a lookup table, and select an optimum antenna mode from a plurality of available antenna modes of the antenna system; wherein the selected antenna mode provides optimum signal quality while optimizing one or more device requirements selected from: total radiated power (TRP), total isotropic sensitivity (TIS), specific absorption rate (SAR) and hearing aid compatibility (HAC).

The one or more sensors may be individually selected from the group consisting of: capacitive sensors, infrared sensors, and ultrasonic sensors.

The antenna system may comprise two or more antenna elements.

The antenna system may comprise three or more parasitic elements, each of said parasitic elements positioned adjacent to the antenna element.

The antenna system can be adapted to vary an antenna mode for improving signal link quality with a desired base station.

A method for selecting the optimum antenna mode from the plurality of available antenna modes within the antenna system may comprise: determining the current use case of the wireless device; for the current use case, looking up pre-determined electronic requirements for one or more of: total radiated power (TRP), total isotropic sensitivity (TIS), specific absorption rate (SAR) and hearing aid compatibility (HAC); screening the plurality of available antenna modes to determine one or more antenna modes that meet the electronic requirements for the current use case; and selecting the optimum antenna mode from the one or more antenna modes that meet the electronic requirements for the current use case, wherein the optimum antenna mode yields an optimum signal.

The optimum signal characteristics associated with a given antenna mode can be determined from pre-measured data that is stored within memory within the device. Alternatively, the signal characteristics associated with a given antenna mode can be sampled and periodically stored within the memory. A variety of signal analysis algorithms may be implemented in accordance with known methods, including weighting signals and other signal processing techniques.

In some embodiments, an antenna system for use with a wireless device comprises: a modal antenna coupled to one or more proximity sensors and a processor, wherein said antenna system is adapted to determine a current use case of the device and select an optimum mode for maximizing signal quality and meeting one or more electronic requirements selected from: total radiated power (TRP), total isotropic sensitivity (TIS), specific absorption rate (SAR) and hearing aid compatibility (HAC).

We claim:

1. An antenna system for use with a wireless device, comprising:

an antenna element positioned above a circuit board forming an antenna volume therebetween, a first parasitic element positioned adjacent to the antenna element and outside of the antenna volume, and a second parasitic element positioned within the antenna volume;

one or more sensors positioned about the device; and a processor configured to:

utilize information from the one or more sensors to determine a current use case of the device from a plurality of potential use cases, access data stored in a lookup table, and select an optimum antenna mode from a plurality of available antenna modes of the antenna system;

wherein the selected antenna mode provides optimum signal quality while optimizing one or more device requirements selected from: total radiated power (TRP), total isotropic sensitivity (TIS), specific absorption rate (SAR) and hearing aid compatibility (HAC).

2. The antenna system of claim 1, wherein said one or more sensors are individually selected from the group consisting of: capacitive sensors, infrared sensors, and ultrasonic sensors.

3. The antenna system of claim 1, comprising two or more antenna elements.

4. The antenna system of claim 1, comprising three or more parasitic elements, each of said parasitic elements positioned adjacent to the antenna element.

5. The antenna system of claim 1 adapted to vary an antenna mode for improving signal link quality with a desired base station.

6. A method for selecting the optimum antenna mode from the plurality of available antenna modes within the antenna system of claim 1, comprising:

determining the current use case of the wireless device;

for the current use case, looking up pre-determined electronic requirements for one or more of: total radiated power (TRP), total isotropic sensitivity (TIS), specific absorption rate (SAR) and hearing aid compatibility (HAC);

screening the plurality of available antenna modes to determine one or more antenna modes that meet the electronic requirements for the current use case; and selecting the optimum antenna mode from the one or more antenna modes that meet the electronic requirements for the current use case, wherein the optimum antenna mode yields an optimum signal.

* * * * *